US007819339B2

(12) United States Patent
Dieziger

(10) Patent No.: US 7,819,339 B2
(45) Date of Patent: Oct. 26, 2010

(54) ROTARY PROPULSION NOZZLE SET

(76) Inventor: David Douglas Dieziger, 9755 Horseback Ridge Rd., Missoula, MT (US) 59804

( * ) Notice: Subject to any disclaimer, the term of this patent is extended or adjusted under 35 U.S.C. 154(b) by 148 days.

(21) Appl. No.: 12/348,009

(22) Filed: Jan. 1, 2009

(65) Prior Publication Data

US 2010/0163644 A1 Jul. 1, 2010

(51) Int. Cl.

| | |
|---|---|
| ***B05B 3/06*** | (2006.01) |
| ***B05B 1/26*** | (2006.01) |
| ***B05B 3/04*** | (2006.01) |
| ***B05B 3/02*** | (2006.01) |

(52) U.S. Cl. ..... 239/252; 239/251; 239/505; 239/507; 239/509; 239/510; 239/511

(58) Field of Classification Search ..... 239/222.11, 239/222.17, 251–253, 256–258, 261, 461, 239/505, 507, 509–511, 513–515
See application file for complete search history.

(56) References Cited

U.S. PATENT DOCUMENTS

| | | | | |
|---|---|---|---|---|
| 60,052 | A | | 11/1866 | Phillips |
| 270,664 | A | | 1/1883 | Schutz |
| 1,798,488 | A | * | 3/1931 | Orr ..... 239/227 |
| 2,021,710 | A | | 11/1935 | Wilson |
| 3,005,593 | A | * | 10/1961 | Smith ..... 239/252 |
| 3,721,388 | A | | 3/1973 | Green |
| 3,979,066 | A | | 9/1976 | Fortner |
| 5,020,556 | A | | 6/1991 | Lamminen et al. |
| 7,383,845 | B2 | | 6/2008 | Dieziger |
| 2007/0169796 | A1 | | 7/2007 | Johnson |
| 2008/0110476 | A1 | | 5/2008 | Amestoy |

* cited by examiner

*Primary Examiner*—Darren W Gorman
(74) *Attorney, Agent, or Firm*—Lawrence E. Lambelet, Jr.

(57) ABSTRACT

A self-governing spray apparatus for irrigation or cleaning purposes is provided. A spray nozzle at the end of a moment arm and substantially perpendicular to an axis of rotation creates a reaction torque to distribute a spray by spinning. A hinged member thrust into the spray pattern a centrifugal force caused by the spin deflects a portion of the spray and results in a braking action. An equilibrium angular speed is thereby reached by a self-correcting mechanism.

7 Claims, 3 Drawing Sheets

ROTARY PROPULSION NOZZLE SET

FIELD OF THE INVENTION

This invention relates rotary spraying systems, and more particularly to speed-governed rotary spraying systems.

BACKGROUND OF THE INVENTION

Water distribution systems employing rotating nozzles to broadcast water over an area have a number of uses. One use is to effectively irrigate a wide circular zone by means of a sprinkler system. A less common use is for cleaning purposes, whereby the nozzles would be directed more in a focused spray pattern. In both cases, however, it is useful to control the speed of nozzle rotation. In the cleaning example, a slower speed produces a greater impact to the target surface because less of the flow is directed obliquely. The greater impact produces a greater force for dislodging dirt. In the sprinkler case, a slower speed produces a larger broadcast area because, in a similar manner, more of the spray is thrown outwardly and less in a radial direction. An additional benefit of speed control is the prolonged life of the moving parts of the system through the reduction of wear and tear.

In the typical rotating nozzle system, one or more nozzles are placed at distance from an axis of rotation creating a moment arm. As water is forced through the orifice of the nozzle, the reaction force produces torque which propels the spin. The more the stream of water is directed tangentially to the rotational circumference, the greater the torque. One way to reduce the torque, and thereby to control the angular speed, is to direct the stream more upwardly. More upward vectoring serves the cleaning application, and more outwardly upward, the sprinkler circumstance. In both cases, additional friction caused by the downward force component contributes not only to a speed reduction by virtue of friction, but also to system wear and degradation by the same agent.

Controlling the torque by redirecting the spray stream, however, does not compensate for variable water pressure. Supplemental control means have been sought and are present in the prior art. In U.S. Pat. No. 0,270,664 to Henderson, for example, a baffle is placed so as to deflect the stream exiting a nozzle. Doing so diminishes the reaction force and slows the spin. The baffle can be bent to incline more or less into the stream, thereby providing a manual adjustment means. U.S. Pat. No. 2,021,710 to Wilson teaches an oscillating vane placed in the path of one of the nozzles. The speed of rotation can be adjusted by adjusting the amplitude of the oscillation.

In both of the above prior art examples, the control means has to be readjusted with each fluctuation of water pressure due to line pressure surges or other events, such as clogging nozzle ports. In U.S. Pat. No. 3,979,066 to Fortner, the baffle is initially placed out of range of the water stream until a certain speed is reached at which the baffle begins to intersect the inwardly-spiraling water path. In a sense, Fortner's device is self-governing, but only partially so. While it begins braking automatically at a pre-determined angular velocity, it becomes dependent upon manual adjustment thereafter to maintain a constant speed under variable pressure conditions.

What is missing in the prior art is an automated means of controlling angular speed responsive to pressure fluctuations. Such a means would have an equilibrium state whereby a tendency for higher speed would be balanced with a greater resistance, and visa versa for lower speed.

SUMMARY OF THE INVENTION

In view of the above-mentioned unfulfilled needs, the present invention embodies, but is not limited by, the following objects and advantages:

A first objective of the present invention is to provide a self-governing mechanism for a spinning nozzle system spraying water.

A second objective of the present invention is to provide a self-governing mechanism for a spinning water nozzle system that is conservative with respect to wear and tear.

A third objective of the present invention is to provide a self-governing mechanism for a spinning water nozzle system that is adjustable to a preferred speed.

A fourth objective of the present invention is to provide a self-governing mechanism for a spinning water nozzle system that adjusts itself to variations in water pressure.

In a preferred embodiment of the present invention, a self-governing spray apparatus comprises a spinning apparatus connected to a supply of pressurized fluid, wherein the apparatus has an axis of rotation and at least one nozzle. The nozzle is positioned at the end of a moment arm pivoting about the axis of rotation and forms a spray pattern directed substantially perpendicular to the axis. Pressurized fluid flowing through the spinning apparatus causes it to rotate. A means for changeably deflecting some amount of the spray pattern counters the thrust from the flow and results in a reduction of rotational speed. The amount of deflection is responsive to variations in the pressure and enables the governing of a preferred speed of rotation.

In a particularly preferred embodiment, the means for changeably deflecting is a hinged member swinging from the moment arm with the hinge axis parallel to the axis of rotation. The location of the hinged member is proximate to the nozzle such that its extent intersects the spray pattern. The mass and wetted area of the hinged member is sufficient for the centrifugal force acting thereon to swing the hinged member into interference with the spray pattern, the interference deflecting the spray by an amount variable with the centrifugal force.

As this is not intended to be an exhaustive recitation, other embodiments may be learned from practicing the invention or may otherwise become apparent to those skilled in the art.

DESCRIPTION OF THE DRAWINGS

Various other objects, features and attendant advantages of the present invention will become fully appreciated as the same becomes better understood through the accompanying drawings, in which like reference characters designate the same or similar parts throughout the several views, and wherein.

DETAILED DESCRIPTION OF THE PREFERRED EMBODIMENT

Figure 1:
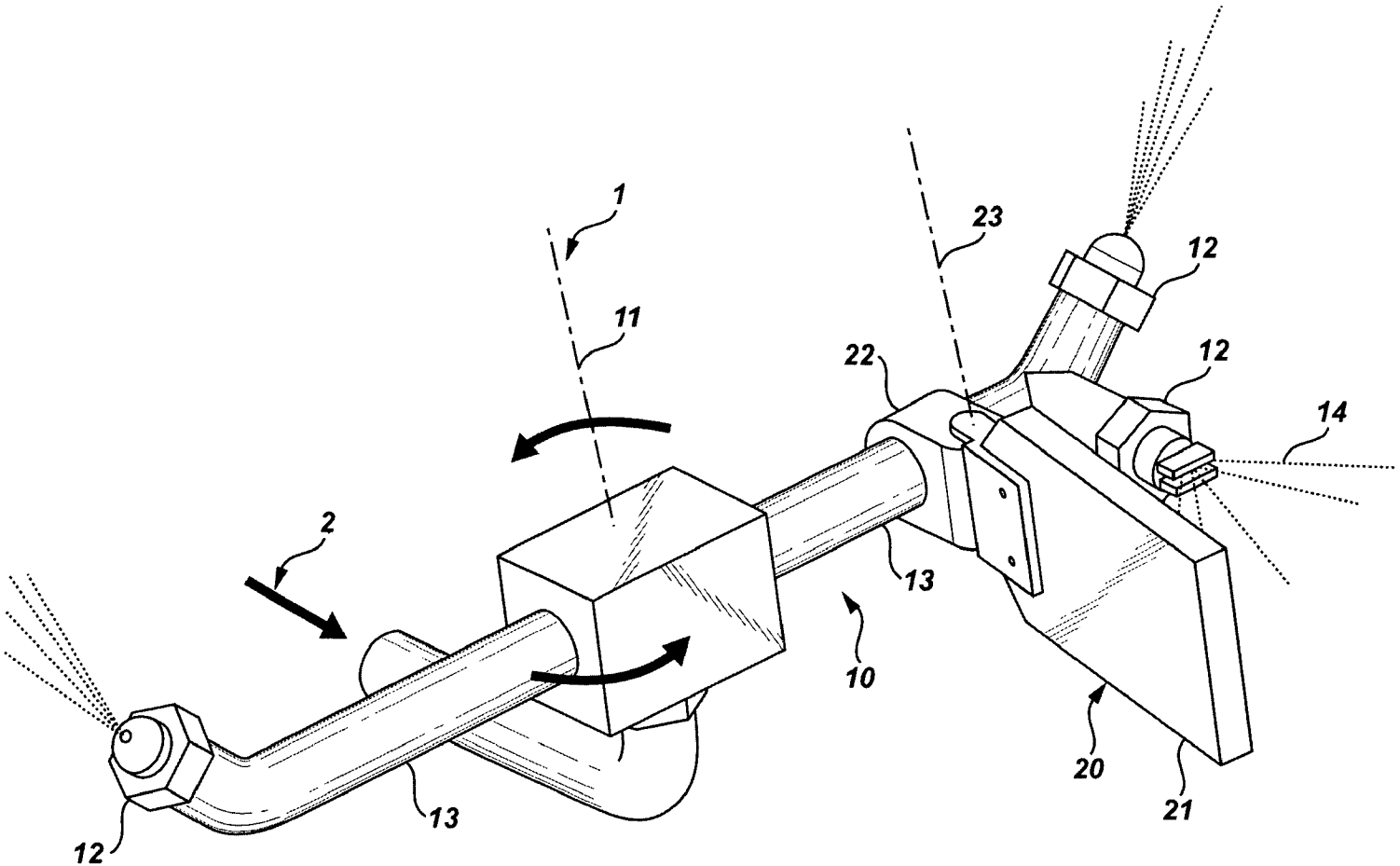
FIG. 1 is a perspective view of the invention.

Referring to FIG. 1, a self-governing spray apparatus 1 is shown comprising a water supply 2, a spinning apparatus 10, and a means for changeably deflecting 20 a stream of water.

The spinning apparatus 10 pivots about an axis of rotation 11. A nozzle 12, located at the end of a moment arm 13, discharges water from the water supply 2 communicating internally. The discharge forms a spray pattern 14 and its tangential thrust creates a torque about axis of rotation 11, shown by a counter-clockwise spin in FIG. 1. The tangential thrust is greatest when spray pattern 14 is directed substantially perpendicular to axis of rotation 11.

In the preferred embodiment, the means for changeably deflecting 20 is a hinged member 21. Hinged member 21 is positioned near the nozzle 12 to interact with and deflect the discharge from the spray pattern 14. Hinged member 21 is a plate-like baffle having mass and extent, the extent such that the reach is sufficient to intersect the spray pattern 14. Hinged member 21 is pivotally mounted to a hinge 22 and swings about hinge axis 23. Hinge axis 23 is parallel to the axis of rotation 11.

Figure 2:
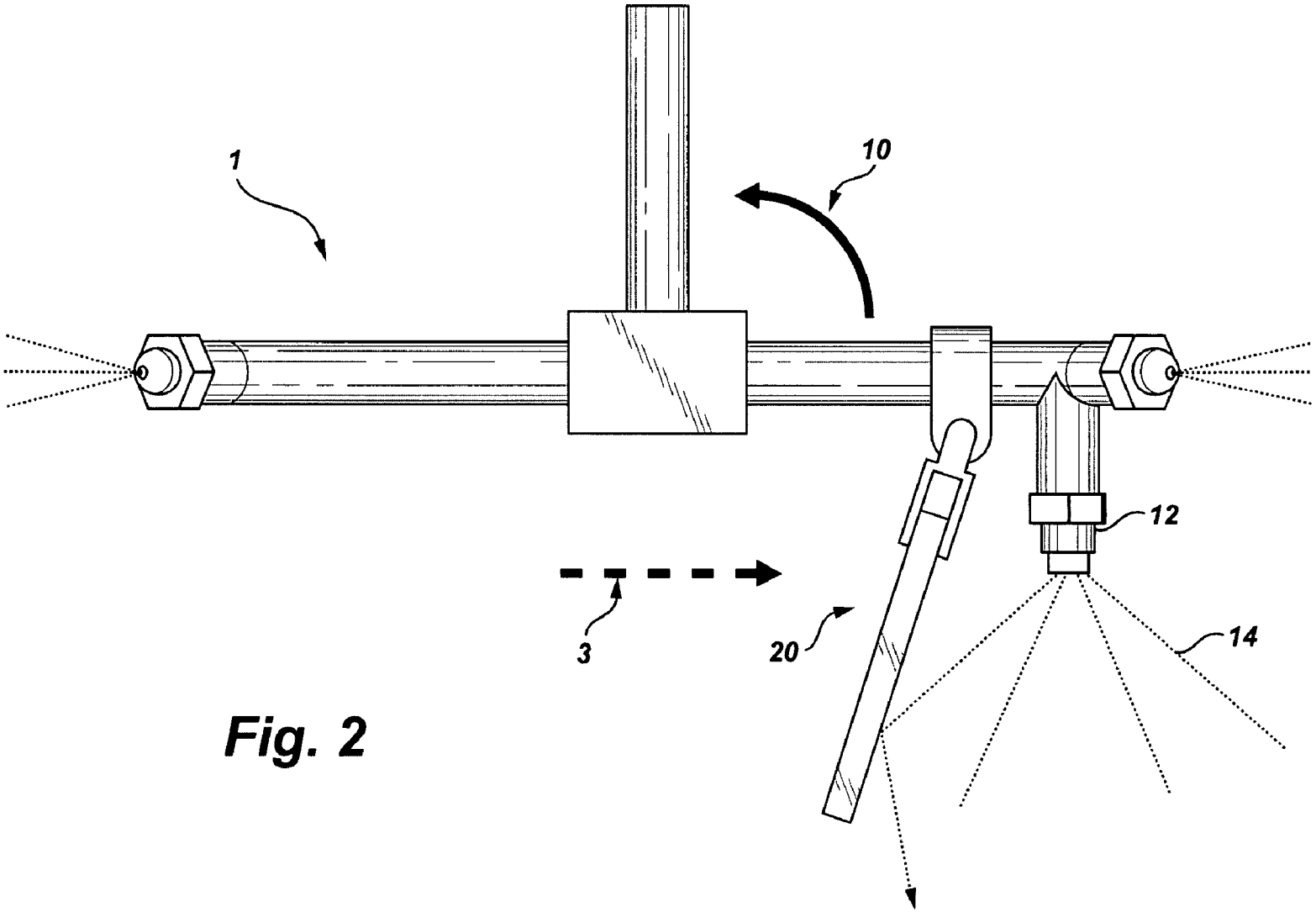
FIG. 2 is a plan view of the invention illustrating a slow rotational speed.
Figure 3:
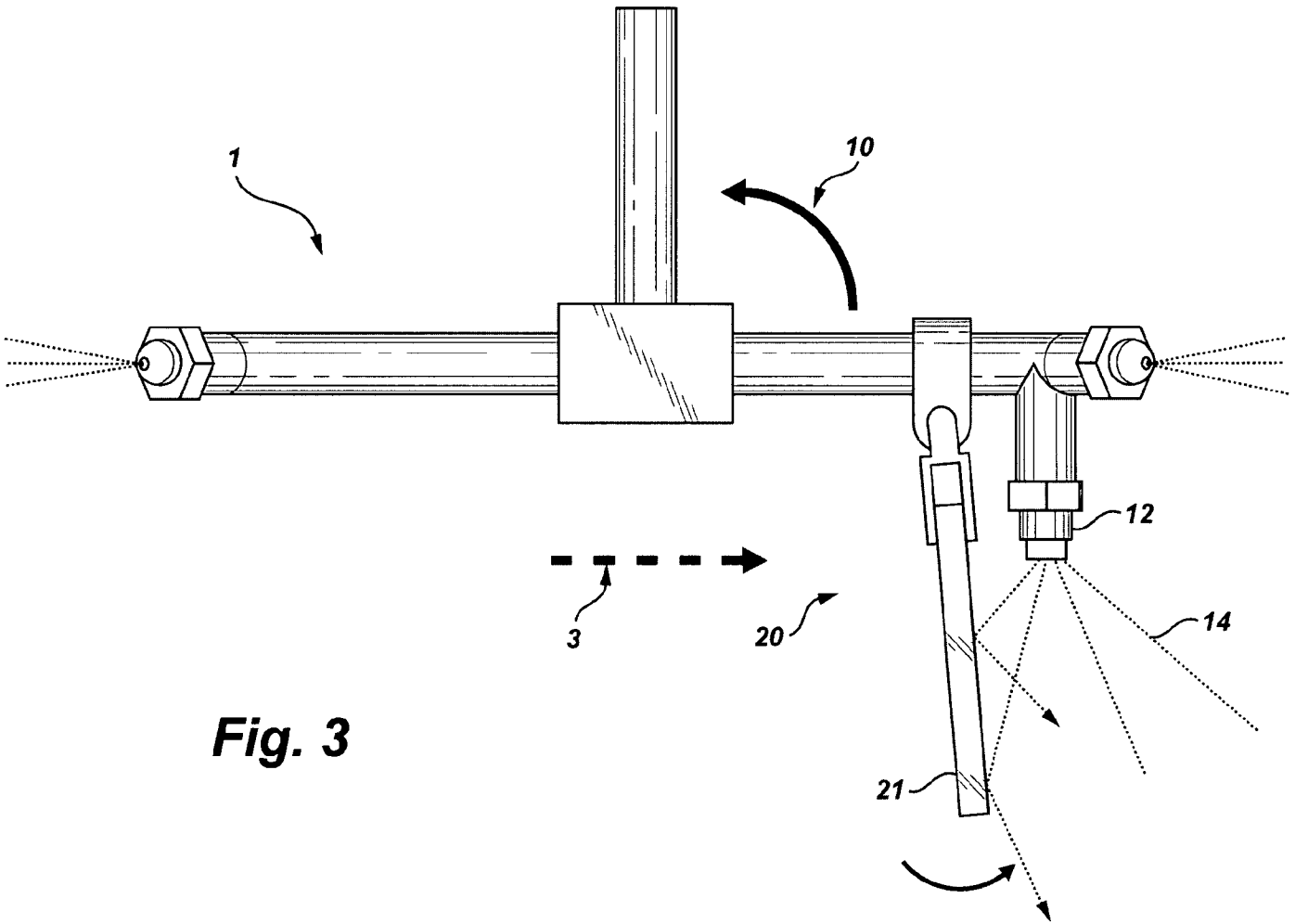
FIG. 3 is a plan view of the invention at a faster rotational speed.

Referring to FIGS. 2 and 3, a centrifugal force 3 operates to swing hinged member 21 into spray pattern 14. The greater the angular speed (see FIG. 3), the greater the amount of deflection caused; and the greater the amount of deflection, the greater the attenuation of thrust. Thus it can be seen that a limiting, or governing, speed is achieved and that that speed is self-maintaining.

In the preferred embodiment, the spray pattern 14 has a flat fan-shape. This directs more of the discharge toward the hinged member 21 and enhances the sensitivity of the system. The limiting speed can be altered by changing the nozzle 12 and the included angle or width of the spray pattern 14. A smaller orifice in the nozzle, for example, would direct more of the water volume to other nozzles in the apparatus, thereby reducing the tangential thrust.

An alternate means for adjusting the governed speed is a means for adjusting the centrifugal force acting on hinged member 21. Since the force is a function of mass, increasing the mass has the effect of greater deflection. Additionally, since the hinged member 21 has its own moment, increasing the distance of the center of mass from the hinge axis 23 produces the same effect. Thus, not only adding mass, but also reshaping the mass, such as in changing the aspect ratio, provides additional means for adjustment.

The hinged member can be comprised of any material having a suitable mass. In the preferred embodiment, the composition is plastic with various size steel weights to adjust the mass and rotational speed. The preferred spray apparatus operates with other nozzles arrayed around the axis of rotation to deliver water for irrigation or cleaning purposes. Only a proportion of the total system flow is diverted to the governor nozzle for control purposes. The preferred spray apparatus operates at speeds of 30-120 rpm with pressures of 100-250 psi. Such a configuration delivers volumes of 20-30 gpm with about 5% going to the governor nozzle. The preferred fan pattern of the spray has a spread of three to five inches at contact with the hinged member.

While a particular form of the invention has been illustrated and described, it will be apparent that various modifications can be made without departing from the spirit and scope of the invention. For example, the nozzle itself could be hingeably articulated at its juncture with the moment arm so that centrifugal force acting on the mass of the nozzle turns the spray outward and away from the tangential. Accordingly, it is not intended that the invention be limited, except as by the appended claims.

What is claimed is:

1. A self-governing spray apparatus, comprising:

a supply of pressurized fluid;

a spinning apparatus connected to the supply having an axis of rotation and at least one nozzle, the nozzle at the end of a moment arm pivoting about the axis of rotation, the nozzle forming a spray pattern, the spray pattern directed substantially perpendicular to the axis of rotation, wherein pressurized fluid flowing through the spinning apparatus causes rotation thereof; and a hinged member swinging from the moment arm, the hinge axis parallel to the axis of rotation, the location of the hinged member proximate to the nozzle such that its extent intersects the spray pattern, the mass and wetted area of the hinged member sufficient for the centrifugal force acting thereon to swing the hinged member into interference with the spray pattern, the interference deflecting the spray by an amount variable with the centrifugal force, the amount of deflection responsive to variations in the pressure, whereby a preferred speed of rotation is governed.

2. The self-governing spray apparatus of claim 1, wherein the spray pattern is fan-shaped.

3. The self-governing spray apparatus of claim 1, further comprising a means for adjusting the governed speed.

4. The self-governing spray apparatus of claim 3, wherein the means for adjusting the governed speed is by changing the configuration of the nozzle.

5. The self-governing spray apparatus of claim 3, wherein the means for adjusting the governed speed is a means for adjusting the applied centrifugal force.

6. The self-governing spray apparatus of claim 5, wherein the means for adjusting the applied centrifugal force is by adding mass to the hinged member.

7. The self-governing spray apparatus of claim 5, wherein the means for adjusting the applied centrifugal force is by changing the aspect ratio of the hinged member.

* * * * *